US008028734B2

(12) United States Patent
Wermuth

(10) Patent No.: US 8,028,734 B2
(45) Date of Patent: Oct. 4, 2011

(54) HAND HELD ELECTRONIC LABEL DISPENSER FOR MULTIPLE LABEL SIZES

(76) Inventor: Eli Wermuth, Moshav Ein-Tamar (IL)

( * ) Notice: Subject to any disclaimer, the term of this patent is extended or adjusted under 35 U.S.C. 154(b) by 986 days.

(21) Appl. No.: 11/422,846

(22) Filed: Jun. 7, 2006

(65) Prior Publication Data

US 2007/0235143 A1 Oct. 11, 2007

(30) Foreign Application Priority Data

Apr. 11, 2006 (IL) ..... 174988

(51) Int. Cl.

| | |
|---|---|
| ***B65C 9/18*** | (2006.01) |
| ***B65C 9/26*** | (2006.01) |
| ***B65C 9/42*** | (2006.01) |
| ***B65C 9/44*** | (2006.01) |

(52) U.S. Cl. ..... 156/361; 156/541; 156/542; 156/577; 156/579; 156/350; 156/DIG. 45; 156/DIG. 46

(58) Field of Classification Search ..... 156/577, 156/DIG. 45, DIG. 46, 350, 362–364, 540–542, 156/584, 579

See application file for complete search history.

(56) References Cited

U.S. PATENT DOCUMENTS

| | | | | |
|---|---|---|---|---|
| 4,022,651 | A * | 5/1977 | Larkins et al. | 156/577 |
| 4,645,549 | A * | 2/1987 | Lalor | 156/54 |
| 5,669,320 | A * | 9/1997 | Stewart et al. | 112/470.07 |
| 5,800,669 | A | 9/1998 | Goodwin | |
| 5,915,864 | A | 6/1999 | Austin | |
| 2007/0125474 | A1 * | 6/2007 | Barker et al. | 156/71 |

FOREIGN PATENT DOCUMENTS

| | | |
|---|---|---|
| EP | 0837001 | 12/1993 |

* cited by examiner

*Primary Examiner* — Katarzyna Wyrozebski Lee
*Assistant Examiner* — Scott W Dodds
(74) *Attorney, Agent, or Firm* — Martin Fleit; Paul D. Bianco; Fleit Gibbons Gutman Bongini & Bianco PL

(57) ABSTRACT

Presented herein is a unique portable electronic hand-held label dispenser that is adjustable to accommodate labels of various widths by lengthening the pins and replacing a lower guide plate, and which additionally incorporates a sensor mechanism that precisely determines the length of each label, in order to accurately advance the roll of labels according to the captured data and dispense a single label at a time, and which includes the added advantage of a unique slotted uptake wheel that efficiently collects the paper backing for easy disposal. Depressing an electronic switch causes a label to be dispensed and also activates the sensor mechanism, which allows a roll of labels to advance until the end of the next label is identified, indicating that the roll has been advanced the full length of a single label, and additionally the uptake wheel rotates to capture the discarded paper backing.

6 Claims, 5 Drawing Sheets

HAND HELD ELECTRONIC LABEL DISPENSER FOR MULTIPLE LABEL SIZES

BACKGROUND OF THE INVENTION

1. Field of Invention

This invention relates generally to hand-held label dispensing devices, and specifically to such devices that accommodate a plurality of label sizes.

2. Description of the Related Art

Hand-held devices for dispensing and applying labels are well known in merchandising and warehousing industries for labeling, applying identification labels, pricing, and other uses. These devices, referred to as labelers, commonly involve a method to automatically advance and dispense a sticker onto individual units. Typical of such prior art devices is EP0837001, which discloses a hand-held labeler that prints and dispenses labels or strips of labels. Such prior art labelers are limited in that they are designed for use with a single width of labels.

U.S. Pat. No. 5,800,669 provides a fixed-width hand-held labeler that may accept labels of different widths by moving the roll mounting members to the width of a roll of labels that has been centered on the labeler. This solution partially addresses the above width limitation, but is not inadequate for labels of very narrow widths, and does not prevent the exiting labels from shifting about.

Another useful feature found on some prior art labelers is the use of sensors in determining the beginning and end of individual labels for registration and alignment purposes. One such method, such as described in U.S. Pat. No. 5,915,864, involves marking the labels and sensing these marks. Alternatively, the translucent areas between the labels may be used in place of imprinted marks. Such methods frequently rely on detecting and measuring the velocity at which the marks pass the sensor, a method that is quite inaccurate.

Furthermore, labelers that use labels with paper backings have another drawback. The paper backing, after being separated from the labels, exits prior art labels in messy strips. The user is forced to regularly remove and discard these strips, an inconvenience that interferes with productive use.

Therefore, there is a need for a single hand-held labeling device that is able to effectively dispense labels of a plurality of widths and lengths and accurately determine the length of each individual label. It would be further advantageous if the same device could control and maintain the discarded paper backing.

SUMMARY OF THE INVENTION

The present invention is a new device that overcomes the previously described shortcomings of the prior art. This unique portable electronic hand-held label dispenser is completely adjustable to accommodate labels of various widths and lengths. Additionally, the incorporated sensor mechanism of the present invention utilizes a novel sensing method in order to determine the length of each label, allowing the roll of labels to advance according to the captured data. Said sensing mechanism identifies distinguishing marks imprinted on the paper backing of a roll of labels to determine the length of each label, which also eliminates the need to provide intervals between the labels. A further feature of the present invention is a unique slotted uptake wheel that efficiently collects the paper backing for easy disposal.

The basic components of the preferred embodiment of the present invention include:

a feed wheel to hold rolls of labels of any length and width;

a sensing mechanism that scans the front and the back of a roll of labels, determining the length of each label by identifying distinguishing marks printed on the roll of labels, in order to establish how far to advance the roll of labels in order to accurately dispense a single label at a time;

a removable uptake wheel for receiving the discarded paper backing from the discharged labels, said uptake wheel equipped with innovative slots that securely hold the paper backing to the uptake wheel, allowing the user to neatly store the discarded paper backing and greatly facilitating disposal of the paper backing;

a removable guide plate and a plurality of extendable pins which are adapted to correspond to labels of various widths; and an optional printer.

A significant feature of the present invention is that, although the hand-held label dispenser holds labels of a fixed minimum width, the invention can easily be completely adjusted to accommodate wider labels by lengthening the pins and replacing the lower guide plate with a wider plate.

When the electronic switch is pressed against a surface, a label is dispensed, the uptake wheel rotates, capturing the discarded paper backing and causing a roll of labels to advance until the sensor mechanism identifies the distinguishing mark at the end of the label indicating that the roll has been advanced the full length of a single label. Once the sensor mechanism determines that the end of the label has been reached, the advancement stops.

BRIEF DESCRIPTION OF THE SEVERAL VIEWS OF THE DRAWINGS

These and further features and advantages of the invention will become more clearly understood in light of the ensuing description of a preferred embodiment thereof, given by way of example only, with reference to the accompanying drawings, wherein.

DETAILED DESCRIPTION OF THE PREFERRED EMBODIMENT

Figure 1:
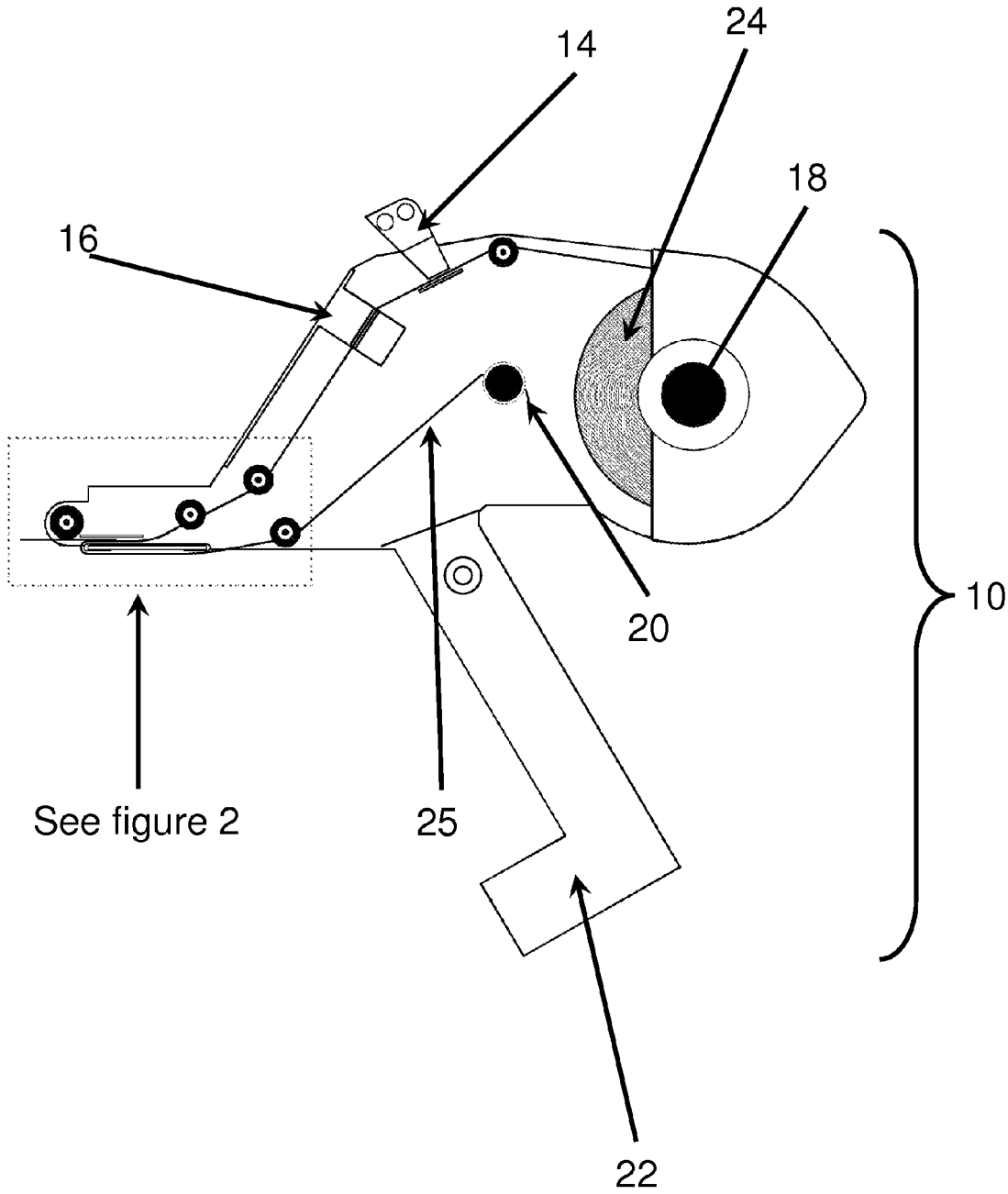
FIG. 1 is an elevated view of the preferred embodiment of the present invention.

The present invention is a new design for a portable electronic hand-held label dispenser 10 that can be adjusted to dispense labels 24 of various widths, and which additionally incorporates a unique sensor method for determining the length of each label 24 and precisely advancing the roll of labels 24 according to the captured data. A further feature of the present invention is a novel slotted uptake wheel 20 that efficiently collects the paper backing 25 for easy disposal. Additionally, the present invention can be equipped with an optional printer 14.

All of the components of the present invention reside within a housing and are accessible by removing a detachable cover 12. FIG. 1 illustrates the basic components of the preferred embodiment of the present invention. The upper portion of hand-held label dispenser 10 houses a feed wheel 18 on which may be fitted rolls of labels 24 of any length and width. Also located in the upper portion is sensor mechanism 16.

In the preferred embodiment of the present invention, sensor mechanism 16 determines the length of labels 24 by scanning both the front and the back of a roll of labels 24 and identifying distinguishing marks located on individual labels 24 that indicate the length of each label. These distinguishing marks may be, inter alia, the gaps located between each label 24 or scannable distinguishing marks, such as incremental black lines, printed on paper backing 25 of labels 24. The distinguishing marks may be positioned to indicate, for example, the end of one label and the beginning of a subsequent label. Unlike prior art devices, this sensor mechanism 16 is able to identify the intervals between sequential labels 24 even where the intervals are so small as to be seemingly non-existent by scanning the imprinted distinguishing marks. These unique scannable distinguishing marks allow sensor mechanism 16 to identify precisely the length of each label 24 and determine exactly how far to advance the roll of labels 24 in order to accurately dispense a single label 24 at a time. The imprinted distinguishing marks allow labels 24 to be positioned on the backing paper with no gaps between labels. As a result, less paper backing 25 is required and the roll of labels 24 will be more compact, or conversely, more labels 24 may be placed on paper backing 25.

In some alternative embodiments of the present invention, sensor mechanism 16 is able to sense the presence of magnetically recognizable material, wherein the distinguishing marks comprise magnetically recognizable material inserted into paper backing 25 or labels 24. In yet other embodiments, sensor mechanism 16 is a touch sensor that senses when a label 24 finishes separating from paper backing 25 to determine the length of labels 24.

Figure 3:
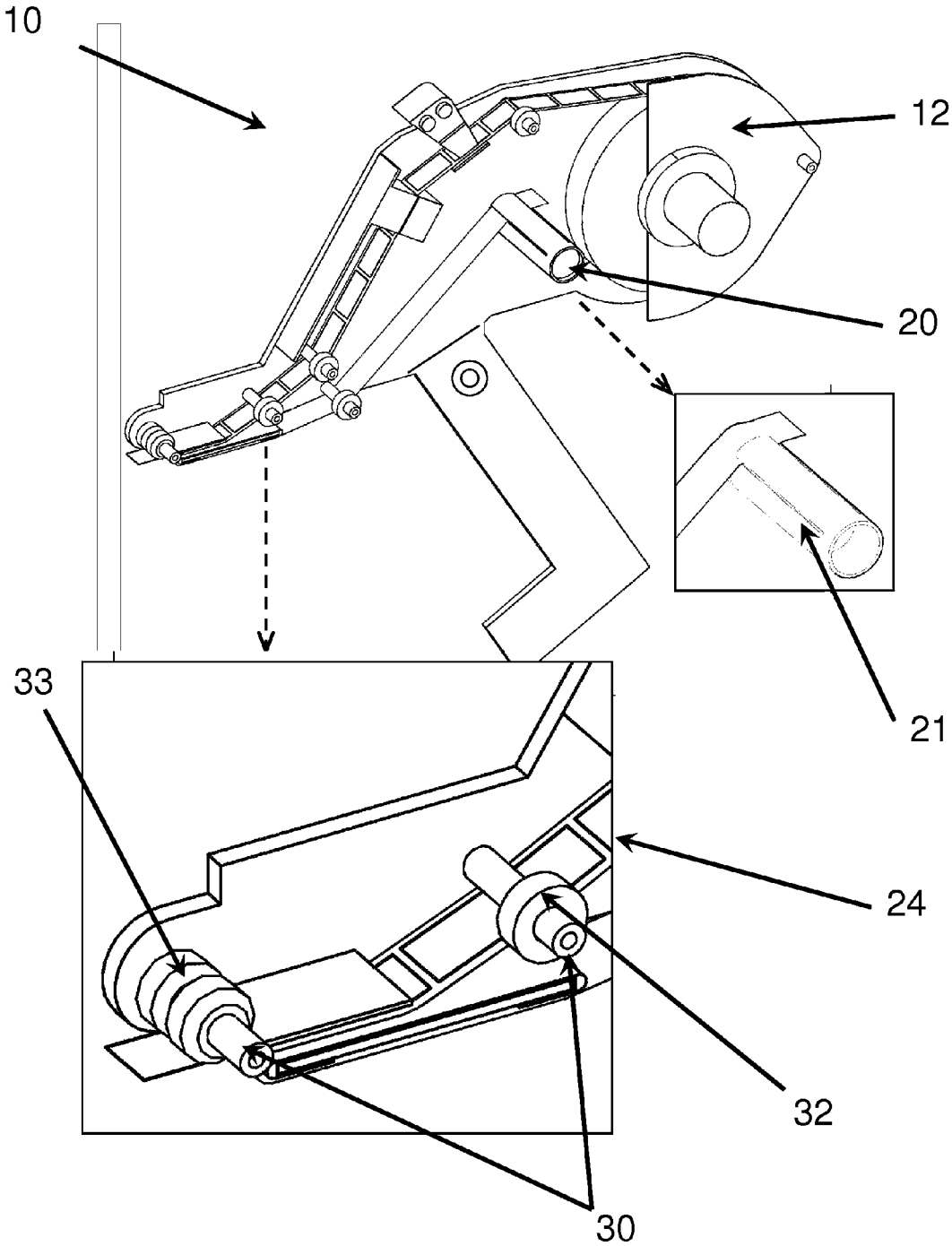
FIG. 3 shows further details of the interior of the preferred embodiment of the present invention, including the uptake wheel, pins, roller, and guides.

A removable uptake wheel 20 is centrally located in the upper portion of label dispenser 10 and receives the discarded paper backing 25 from discharged labels 24. An engine turns uptake wheel 20, which in turn drives feed wheel 18, pulling the roll of labels 24 throughout label dispenser 10. Uptake wheel 20 is also equipped with innovative slots 21, seen in FIG. 3, that are intended to securely hold paper backing 25 to uptake wheel 20 without the use of adhesive or other bonding material. This original slotted uptake wheel 20 allows the user to neatly store discarded paper backing 25 and greatly facilitates disposal of paper backing 25.

A removable lower guide plate 28, together with a fixed upper guide plate 26, functions to direct labels 24 out through an opening while directing discarded paper backing 25 up to uptake wheel 20. The width of lower guide plate 28 corresponds to the width of labels 24. Lower guide plate 28 can be replaced with plate extensions 29 to accommodate wider labels 24.

Figure 2:
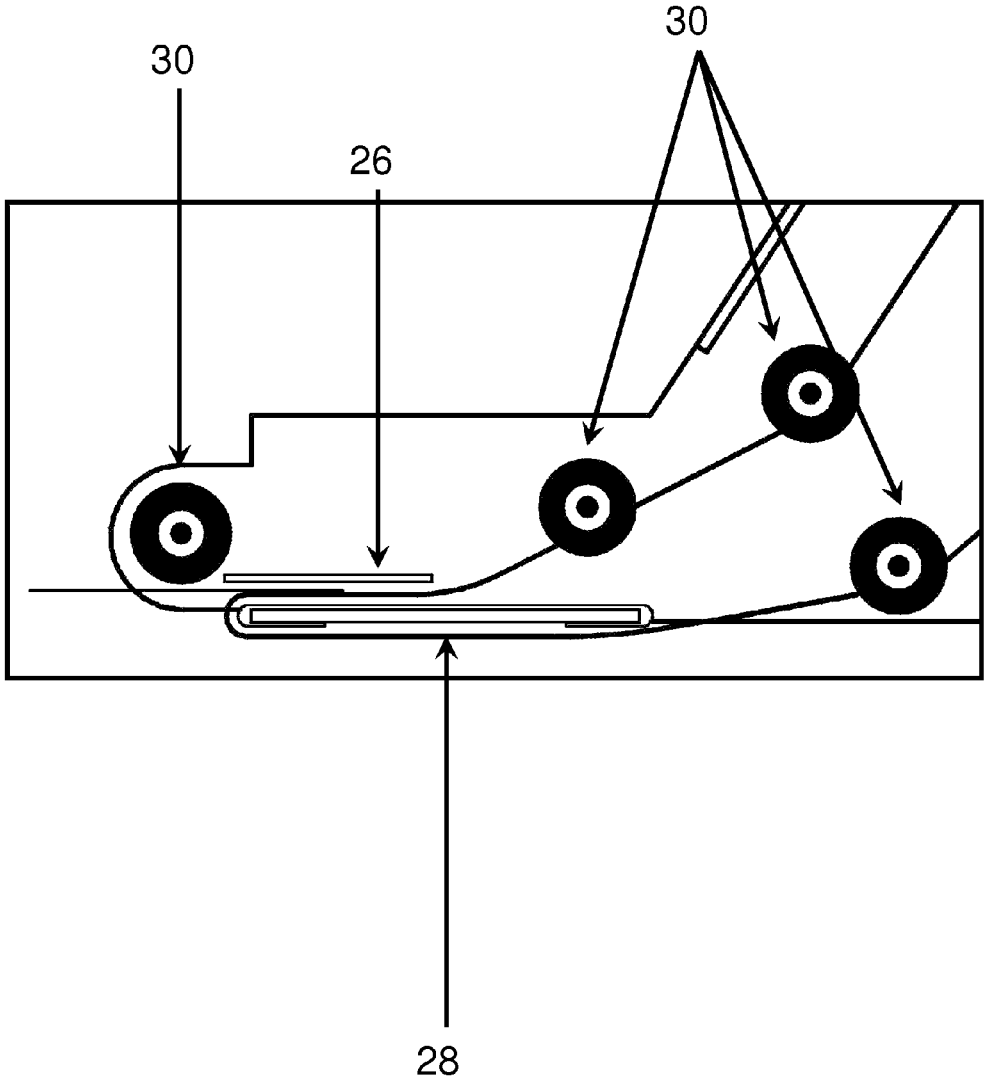
FIG. 2 shows a detailed view of the pins in the present invention.

Label dispenser 10 is further equipped with a plurality of extendable pins 30 that guide labels 24 through label dispenser 10. Pin extensions 31 can be attached to each pin 30 in order to accommodate labels 24 with wider widths. FIG. 2 shows the configuration of several of these pins 30 in relation to the upper guide plates 26 and lower guide plates 28.

Finally, a handle 22 allows the user to comfortably grip label dispenser 10. Handle 22 is mounted on a track 23 that allows handle 22 to move left and right according to the current width of label dispenser 10 in order to compensate for the change in balance when adjusted for wider or narrower labels 24.

Figure 4:
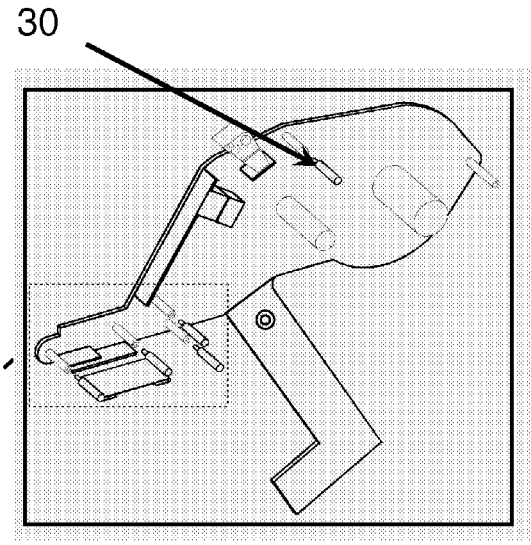
FIG. 4 is a perspective view of the preferred embodiment of the present invention.
Figure 41:
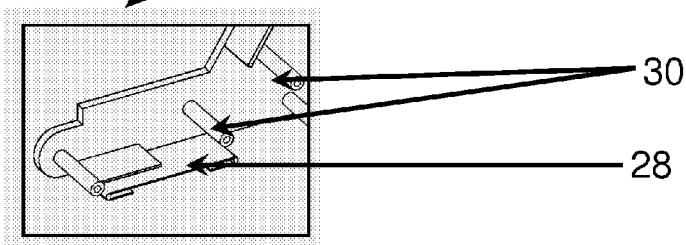
FIG. 41 shows a detailed view of the plate and pins, configured for narrow labels.
Figure 42:
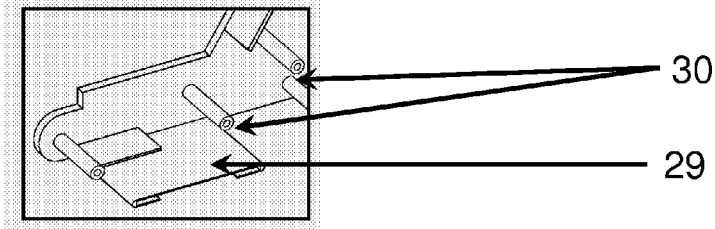
FIG. 42 is a perspective view of the preferred embodiment of the present invention, demonstrating the insertion of the extensions that will accommodate wide labels.
Figure 43:
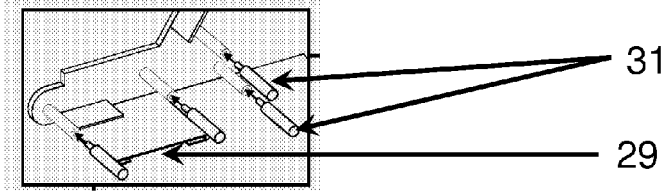
FIG. 43 further details the insertion of the extensions.
Figure 5:
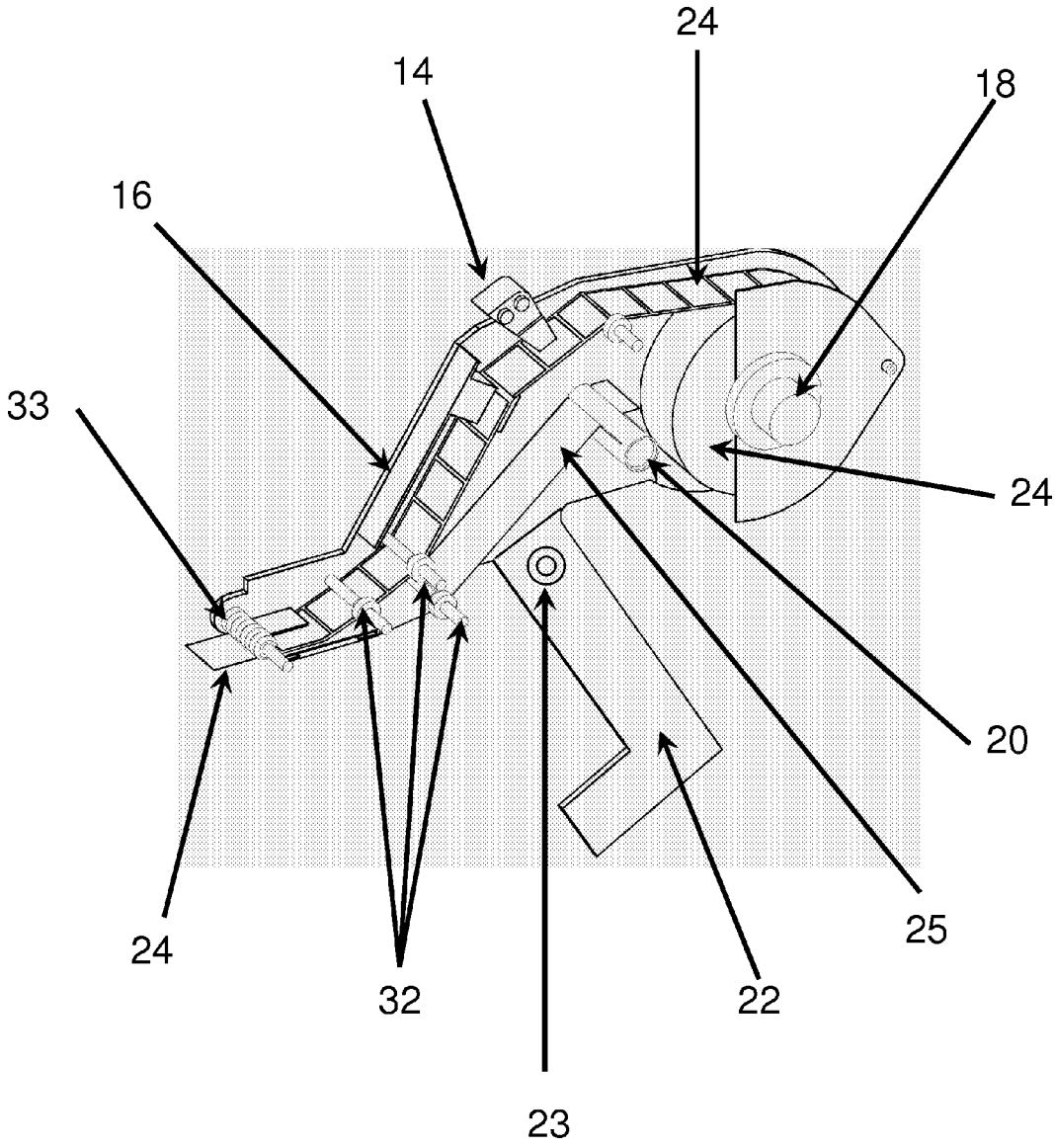
FIG. 5 is a perspective view of the preferred embodiment of the present invention, fully configured for wide labels.

A significant feature of the present invention is that, although hand-held label dispenser 10 is configured to fit labels 24 of a fixed minimum width, the invention can easily be adjusted to accommodate labels 24 of wider widths. This is accomplished by lengthening pins 30 and replacing lower guide plate 28, as shown in FIGS. 4, 41, 42, and 43. FIG. 4 shows the location of pins 30 that are to be extended and FIGS. 41, 42, and 43 describe the process. FIG. 41 shows several pins 30 and lower guide plate 28 in the minimum width configuration. FIG. 42 shows a replaced plate extension 29 that replaces lower guide plate 28. FIG. 43 describes pin extensions 31 being affixed to pins 30. In the preferred embodiment, pin extensions 31 join pins 30 by means of mated threads; however, there exists the option of affixing pins 30 and pin extensions 31 by other means as well. Referring now to FIG. 5, the preferred embodiment of the present invention is shown fully configured for wider labels 24. By adjusting the width of the entire label dispenser 10 to correspond to the width of the labels 24, the present invention ensures that labels 24 are held in place during the entire course of travel through the device. Very narrow labels 24 will travel with the same ease and stability as much wider labels 24.

In an alternative embodiment, hand-held label dispenser 10 is equipped with an optional printer 14. In such embodiments, said optional printer 14 also resides in the upper portion of label dispenser 10. Optional printer 14 uses existing technology to print user-defined messages onto individual labels 24.

A general description of the process for preparing and operating the preferred embodiment of the present invention is as follows.

Cover 12 is removed and pins 30 and lower guide plate 28 are configured according to the width of labels 24 to be used, affixing pin extensions 31 and plate extensions 29 as required. The roll of labels 24 is placed on feed wheel 18. Labels 24, still attached to paper backing 25, are then threaded over pins 30 in the upper portion of the present invention, under the head of optional printer 14, and through sensor mechanism 16. Labels 24 continue down under the subsequent pins 30, between upper guide plates 26 and lower guide plates 28, and in front of roller 33 on the front most pin 30, which assists in separating labels 24 from paper backing 25. Paper backing 25, with labels 24 dispensed, then doubles back under both lower guide plate 28 and the final pin 30 and is secured in slots 21 of uptake wheel 20. Once the threading is complete, rubber guides 32 are placed on each pin 30. Rubber guides 32 can be laterally adjusted on pins 30 in order to fit snuggly along the edge of paper backing 25, further directing labels 24 and paper backing 25 to remain in place throughout the length of the run between feed wheel 18 and uptake wheel 20. Lastly, cover 12 is replaced.

When the user presses the electronic switch located on the edge of the front of label dispenser 10 against a surface in order to dispense a new label 24, the following actions occur. A label 24 is dispensed from label dispenser 10. Uptake wheel 20 advances the roll of labels 24 until sensor mechanism 16 identifies the distinguishing mark at the end of a label 24 indicating that the roll has been advanced the full length of a single label 24. Uptake wheel 20 also rotates to capture discarded paper backing 25. In an alternative embodiment where a printer 14 is installed, a new label 24 will be printed at this point. Once sensor mechanism 16 determines that the end of a label 24 has been reached, uptake wheel 20 stops advancing the roll of labels 24. These actions are repeated for each depression of the electronic switch.

Electronic label dispenser 10 is operated by rechargeable batteries located within handle 22 of the device in the preferred embodiment. In some embodiments, there is also the option of using other sources of power.

While the above description contains many specifics, these should not be construed as limitations on the scope of the invention, but rather as exemplifications of the preferred embodiments. Those skilled in the art will envision other possible variations that are within the scope of the invention. Accordingly, the scope of the invention should be determined not by the embodiment illustrated, but by the appended claims and their legal equivalents.

What is claimed is:

1. A portable electronic hand-held label dispenser apparatus which is adjustable to accommodate labels of different size, said apparatus including: a housing comprised of detachable parts;

a. a fixed size upper guide plate and a plurality of replaceable lower guide plates having different sizes, wherein any one of the replaceable guide plates having different sizes can be attached and removed from the dispenser apparatus such that replacing one lower guide plate with another lower guide plate effectively changes the width of the dispenser apparatus in order to accommodate different label widths;

b. a sensor for determining the length of each label, c. a feed wheel on which a roll of labels is fitted, wherein said feed wheel operation is controlled in accordance with the identification of the label length; and d. a removable slotted uptake wheel for collecting a paper backing from the label, located in between the detachable parts, wherein the uptake wheel includes at least two slots open on one side, such that the edge of the paper backing is snapped in-between the slots and can be removed from the housing when detaching the uptake wheel, wherein each of said lower guide plates assists in separating each label from the paper backing for the dispensing thereof.

2. The label dispenser apparatus of claim 1 further comprising extendable pins for changing the width of the of the label dispenser apparatus in order to accommodate labels of different widths.

3. The label dispenser apparatus of claim 1 further comprising a handle for gripping the label dispenser apparatus, wherein the handle is mounted on a track, allowing the handle to move left and right in accordance with the current width of the label dispenser apparatus, moving the handle between positions where each position is adjusted to a different width of the labeler dispenser apparatus.

4. The label dispenser apparatus of claim 1 further comprising a printer residing on the upper portion of the label dispenser apparatus for printing user-defined messages onto individual labels.

5. A portable electronic hand-held label dispenser apparatus, said apparatus comprising:

a housing comprised of two detachable parts connected by replaceable pins, wherein the replaceable pins having different sizes can be used to accommodate different label width;

a feed wheel on which a roll of labels is fitted, located in between the detachable parts at the rear part of the housing, said feed wheel being connected to the detachable parts by its central axis;

a removable slotted uptake wheel for collecting a paper backing from the labels, located in between the detachable parts at the central part of the housing, wherein the uptake wheel includes at least two slots open on one side, such that the edge of the paper backing is snapped in-between the slots and can be removed from the housing when detaching the uptake wheel, wherein the slotted uptake wheel and feed wheel are separated by a distance substantially equal to maximum width of the rolled paper on the feed wheel;

a printer residing on the upper portion of the label dispenser for printing user-defined messages onto individual labels;

an optical sensor residing on the upper portion of the label dispenser below the printer configured to identify gaps between the labels, for determining the length of each label, wherein the uptake wheel advances the roll of paper until a distinguishing mark is identified;

a fixed size upper guide plate and a plurality of replaceable lower guide plates having different sizes, wherein any one of the replaceable guide plates having different sizes can be attached and removed from the dispenser apparatus such that replacing one lower guide plate with another lower guide plate effectively changes the width of the dispenser apparatus in order to, accommodate different label widths wherein each of said lower guide plates assists in separating each label from the paper backing for the dispensing thereof; and wherein the replaceable pins are positioned at different locations along the edge of the housing and support the labels and paper backing along a route between the feeding wheel and the slotted uptake wheel through the printer, the optical sensor and guide plates.

6. A portable electronic hand-held label dispenser apparatus, said apparatus comprising:

a housing comprised of two detachable parts connected by replaceable pins, wherein the pins of different size can be used to accommodate different label width;

a feed wheel on which a roll of labels is fitted, located in between the detachable parts at the rear part of the housing, said feed wheel being connected to the detachable parts by its central axis;

a removable slotted uptake wheel for collecting a paper backing from the labels, located in between the detachable parts at the central part of the housing, wherein the uptake wheel includes at least two slots open on one side, such that the edge of the paper backing is snapped in-between the slots and can be removed from the housing when detaching its parts, wherein the slotted uptake wheel and feed wheel are separated by a distance substantially equal to maximum width of the rolled paper on the feed wheel;

an optical sensor residing on the upper portion of the label dispenser configured to identify gaps between the labels, for determining the length of each label, wherein the uptake wheel advances the roll of paper until a distinguishing mark is identified; and a fixed size upper guide plate and a plurality of replaceable lower guide plates having different sizes, wherein any one of the replaceable guide plates having different sizes can be attached and removed from the dispenser apparatus such that replacing one lower guide plate with another lower guide plate effectively changes the width of the dispenser apparatus in order to accommodate different label widths wherein each of said lower guide plates assists in separating each label from the paper backing for the dispensing thereof;

wherein the replaceable pins are positioned at different locations along the edge of the housing and support the labels and paper backing along a route between the feeding wheel and the slotted uptake wheel through the optical sensor and guide plates.

* * * * *